US005224715A

United States Patent [19]

Downes et al.

[11] Patent Number: 5,224,715

[45] Date of Patent: Jul. 6, 1993

[54] SUPPORTED-LIP LOW INTERFERENCE METAL STAB SEAL

[75] Inventors: Stephen Downes, Farsley; David Gill, Otley, both of England

[73] Assignee: Cooper Industries, Inc., Houston, Tex.

[21] Appl. No.: 819,302

[22] Filed: Jan. 9, 1992

[30] Foreign Application Priority Data

Jan. 17, 1991 [EP] European Pat. Off. ..... 91300331.5

[51] Int. Cl.[5] ..... E21B 33/128

[52] U.S. Cl. ..... 277/190; 277/205; 166/88

[58] Field of Search ..... 277/190, 117, 118, 205; 166/115, 116, 181, 203, 208, 216, 86, 88, 191, 179, 203; 285/133.2, 140, 338, 917, 146, 141-144

[56] References Cited

U.S. PATENT DOCUMENTS

| | | | |
|---|---|---|---|
| 3,288,472 | 11/1966 | Watkins | 277/205 |
| 3,337,223 | 8/1967 | Nusbaum | 277/205 |
| 3,378,269 | 4/1968 | Castor | 277/205 |
| 4,531,711 | 7/1985 | Bunch et al. | 277/205 X |
| 4,553,759 | 11/1985 | Kilmoyer | 277/205 X |
| 4,595,053 | 6/1986 | Watkins et al. | 285/141 X |
| 4,658,847 | 4/1987 | McCrone | 277/205 X |
| 4,665,979 | 5/1987 | Boehm, Jr. | 166/208 |
| 4,739,992 | 4/1988 | Smetana | 277/205 X |
| 4,741,509 | 5/1988 | Bunch et al. | 277/205 X |
| 4,742,874 | 5/1988 | Gullion | 166/348 |
| 4,749,047 | 6/1988 | Taylor | 166/382 |
| 4,751,965 | 6/1988 | Cassity | 166/208 X |
| 4,766,956 | 8/1988 | Smith et al. | 277/177 X |
| 4,900,041 | 2/1990 | Hopkins et al. | 166/115 X |
| 4,949,787 | 8/1990 | Brammer et al. | 285/140 X |
| 4,960,172 | 10/1990 | Nelson | 166/208 |
| 5,044,432 | 9/1991 | Cunningham et al. | 285/133.2 X |
| 5,044,672 | 9/1991 | Skeels et al. | 285/917 X |

FOREIGN PATENT DOCUMENTS

| | | | |
|---|---|---|---|
| 0999705 | 7/1984 | U.S.S.R. | 277/205 |
| 0532348 | 1/1941 | United Kingdom | 277/205 |
| 0787712 | 12/1957 | United Kingdom | 285/146 |

*Primary Examiner*—William A. Cuchlinski, Jr.
*Assistant Examiner*—James K. Folker
*Attorney, Agent, or Firm*—William Bruce Patterson; Jackie L. Duke; Alan R. Thiele

[57] ABSTRACT

An improved metal-to-metal seal of a generally U shaped configuration which utilizes an enlarged seal portion on the interior and exterior of the inner and outer seal legs to effect an initial seal. The initial interference of the seal legs is maintained by disposing a solid support ring in the annulus between the seal legs with holes in the support ring to prevent pressure lock and to balance pressure distribution within the seal. The invention is shown in a unidirectional form with a single pair of seal legs extending axially from an annular base and in a bidirectional form with a pair of seal legs extending axially in both directions from an annular base. An alternative form of the invention discloses a support member of U shaped configuration which allows greater flexibility in the seal legs while maintaining initial sealing contact. This support member also has holes to prevent pressure lock and to balance pressure distribution within the seal. The seal legs are manufactured of a relatively softer material while the support member is manufactured of a higher strength material to ensure an initial interference type seal.

8 Claims, 5 Drawing Sheets

SUPPORTED-LIP LOW INTERFERENCE METAL STAB SEAL

BACKGROUND

As oil and gas exploration has required the drilling of wells to greater and greater depths, the use of metal-to-metal seals has become more desirable and in some cases essential. Previous designs for metal-to-metal seals have typically required an activation means of one form or another, resulting in increased complexity and increased difficulty in deploying the seals. Those designs which did not require additional activation means usually depended upon an initial interference between the seal element and the surfaces to be sealed against. These interference type seals could be damaged during the initial installation procedure which required the seal element to be "stabbed" into position. Also, these interference type metal-to-metal seals were made of a relatively soft metal to allow the seal element to "flow" and fill in scratched or damaged surfaces. Since the seal element was constructed from relatively soft metal, it would quickly lose its initial interference with the surfaces sealed against and commence leaking.

The present invention relates to an interference type metal-to-metal seal which uses low interference between the seal element and the surfaces sealed against in conjunction with various support elements to maintain this initial sealed condition. In the E. E. Castor U.S. Pat. No. 3,378,269, a metal-to-metal seal of a generally U shape is disclosed which establishes an initial seal by interference between the seal element and the surfaces sealed against.

The C. F. Boehm, Jr. U.S. Pat. No. 4,665,979 discloses a metal-to-metal seal for use in the annulus between a casing hanger and wellhead housing. The seal is U shaped and has no initial sealing interference when installed. An energizer ring is forced between the legs of the U shaped member to urge the legs into sealing engagement with the hanger and housing. The energizer ring has ports which prevent excessive fluid pressure during energization of the seal. The S. D. Gullion U.S. Pat. No. 4,742,874 discloses a similar type of seal in which a U shaped seal of unequal length legs is urged into sealing engagement by wedge rings.

The W. M. Taylor U.S. Pat. No. 4,749,047 discloses an annular wellhead seal which is activated by inserting the seal into the annulus to be sealed and forging the upper rim of the hanger outward with pressure into sealing engagement with the seal.

The J. D. Smith et al. U.S. Pat. No. 4,766,956 discloses another annular wellhead seal which uses upper and lower U shaped seal legs with a curved tip. The curved tips are moved into engagement with the seal bores by mechanical activation means.

SUMMARY

This invention pertains to a metal-to-metal seal which is energized by an initial interference between the seal element and the tubular members whose annulus is sealed. In one form, the seal element is of a generally U shaped configuration with an enlarged portion medially located on the interior and exterior of the inner and outer leg respectively. Optimally, these enlarged portions are located 0.414 times the length of the seal leg from the tip of the seal leg. These enlarged seal portions provide the initial sealing interference when the seal element is installed. In the annular space defined by the seal legs, a support ring is disposed therebetween which supports the seal legs at their tips and ensures the initial sealing interference will be maintained. With the support ring thus positioned, the lowest stress is induced in the seal leg and the enlarged seal surfaces remain parallel to the axis of the seal and thereby ensure that the initial sealing contact will be maintained.

An alternate embodiment of the invention is of a generally U shaped configuration with an enlarged portion on the interior and exterior of the inner and outer leg respectively, adjacent the tip of the seal element. These enlarged portions provide the initial sealing interference when the seal element is installed. The seal element is of a relatively softer metal than the bodies sealed against. In the annular space defined by the seal legs, a support ring is disposed therebetween which is of a relatively harder material. This harder support ring allows use of a softer seal material while ensuring that the initial sealing interference will be maintained.

An object of the present invenion is to provide an improved interference type metal-to-metal seal which allows use of a relatively soft metal seal material which enhances seal performance.

Another object of the present invention is to provide a metal-to-metal seal with means for maintaining the initial sealing interference to enhance the performance of the seal.

A further object of the present invention is to provide a metal-to-metal seal which requires only low interference for its initial sealing, thereby minimizing the force required for stabbing the seal into position.

A still further object of the present invention is to provide a reliable metal-to-metal seal which eliminates the need for additional activation means.

BRIEF DESCRIPTION OF THE DRAWINGS

These and other objects and advantages of the present invention are set forth below and further made clear by reference to the drawings wherein.

DESCRIPTION OF THE PREFERRED EMBODIMENT

Figure 1A:
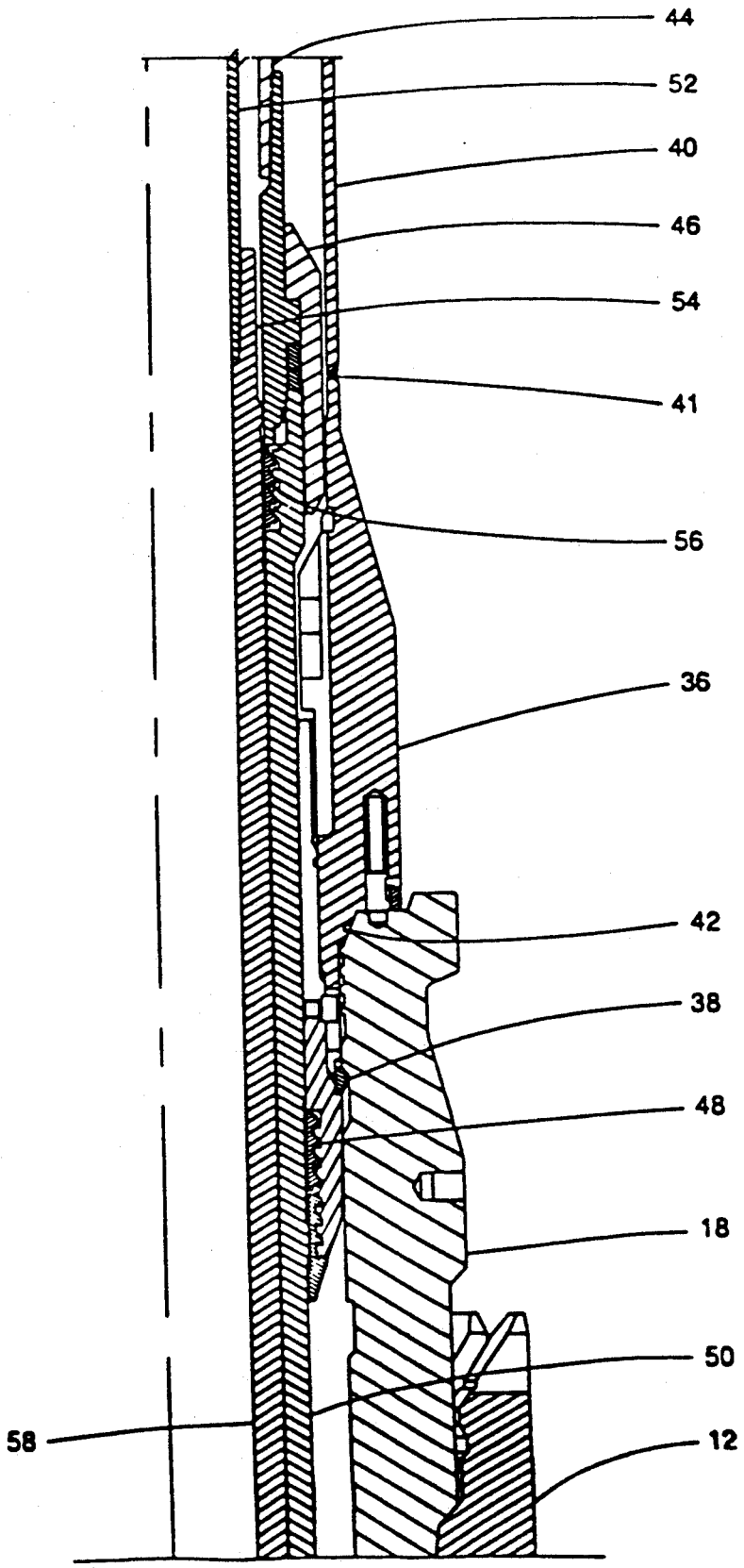
FIGS. 1A and 1B are sectional elevation views of a typical wellhead tieback installation where the improved seal of the present invention is used.
Figure 1B:
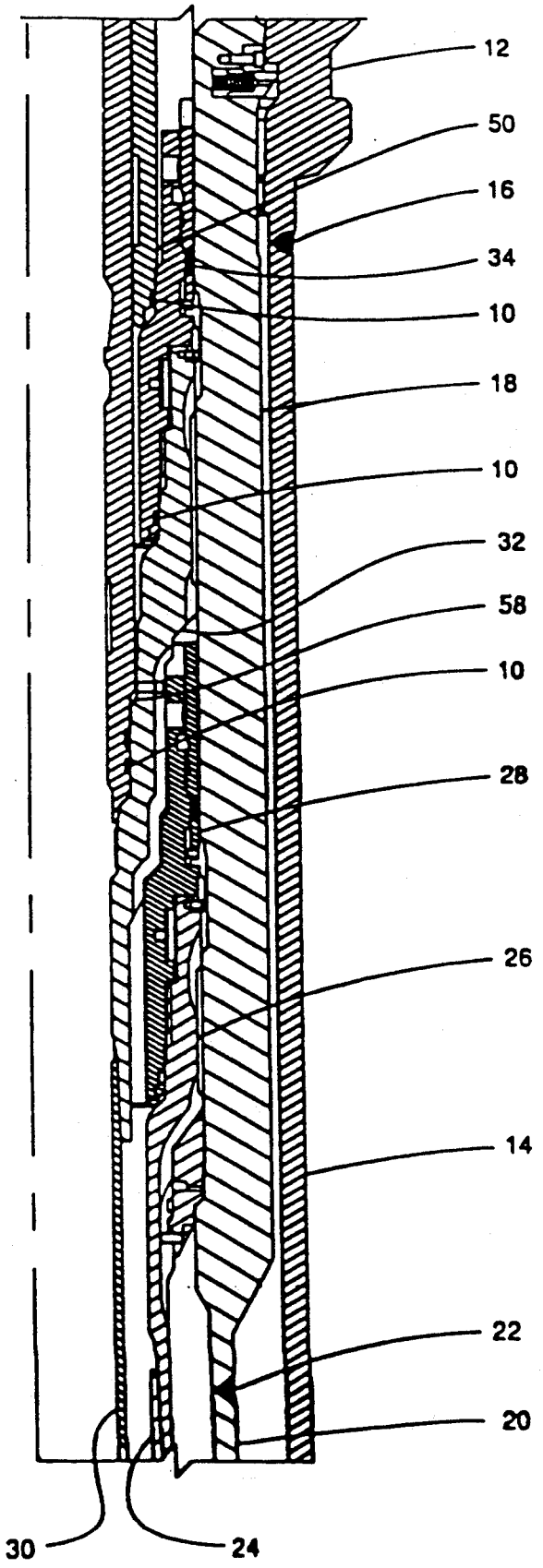

With reference to FIGS. 1A and 1B, the present invention is shown in a typical subsea tieback application wherein the improved metal seal, denoted generally by numeral 10 is used as an annulus seal and as a tieback or stab seal. The 30" housing 12 is vertically disposed on the ocean floor and has structural pipe 14, typically 30" in diameter, attached thereto by suitable means, such as circumferential weld joint 16. An 18¾" housing 18 is disposed therein in a manner well known to those skilled in the art with conductor pipe 20, typically 20" in diameter, attached by suitable means as circumferential weld joint 22.

Inner casing 24 is suspended within wellhead housing 18 by casing hanger 26 with annulus seal means 28 disposed therein. In a similar manner, production casing 30 is suspended within annulus seal means 28 by casing hanger 32. An annulus seal means 34 is disposed therein to seal the annulus between inner casing 24 and production casing 30. The upper portion of wellhead housing 18 has tieback connector 36 structurally connected thereto by latching means 38. Outer tieback casing 40, typically of the same diameter as conductor casing 20, is connected to tieback connector 36 by suitable means as circumferential weld 41 and extends to the surface with suitable pressure control equipment (not shown) mounted thereon. Suitable sealing means, such as O ring 42, is disposed between tieback connector 36 and wellhead housing 18 to ensure pressure integrity of the annulus between the conductor pipe 20 and inner casing 24.

Intermediate tieback casing 44 is threaded into intermediate tieback connector 46 which in turn is structurally connected to tieback connector 36 by expansible latch means 48. Intermediate tieback connector 46 extends axially below latch means 48 and terminates with seal nose 50 sealing within annulus sealing means 34. Improved sealing apparatus 10 of the present invention provides the sealing means between seal nose 50 and annulus sealing means 34.

Production tieback casing 52 is threaded into production tieback connector 54 which is structurally connected to intermediate tieback connector 46 by expansible latch means 56. In a manner similar to intermediate tieback connector 46, production tieback connector 54 extends axially below latch means 56 and terminates with seal nose 58. Sealing between seal nose 58 and casing hanger 32 is provided by improved sealing apparatus 10 of the present invention.

Figure 2:
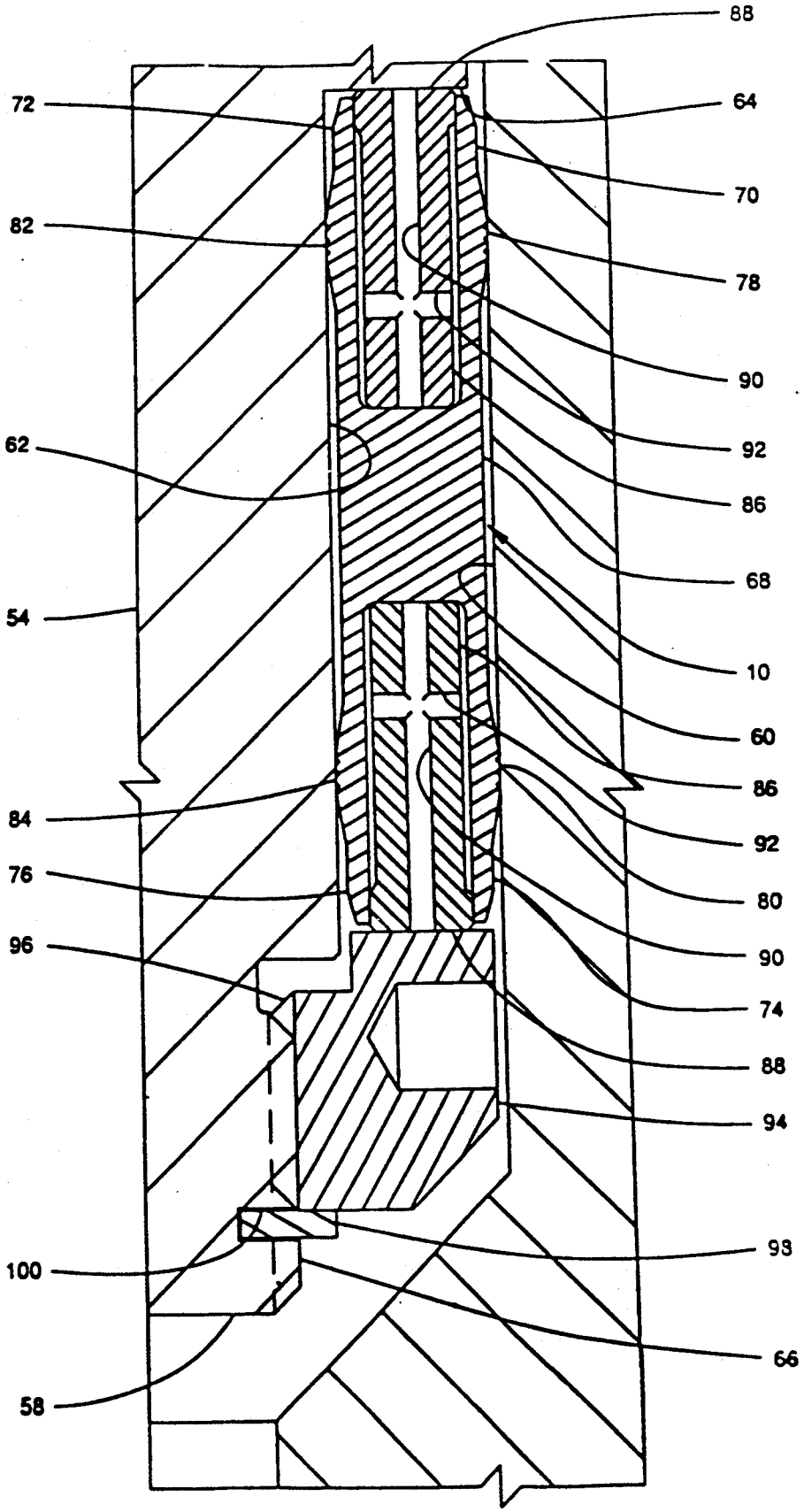
FIG. 2 is an enlarged partial sectional view of the preferred embodiment of the seal in its bidirectional sealing configuration.

Referring to FIG. 2, improved sealing apparatus 10 is shown disposed on the exterior of seal nose 58 at the lowermost portion of production tieback connector 54, sealing within seal bore 60 of casing hanger 32. Reduced diameter portion 62 of seal nose 58 ends at radial shoulder 64 with seal 10 sealingly disposed thereon. An external thread 66 is positioned axially below seal surface 62 for purposes to be explained hereinafter.

Seal apparatus 10 includes annular base portion 68 with upper outer seal leg 70 and upper inner seal leg 72 extending axially and upwardly therefrom. Lower outer seal leg 74 and lower inner seal leg 76 extend axially and downwardly from base portion 68 in a similar manner. Outer seal legs 70 and 74 have enlarged diameter sealing surfaces 78 and 80 disposed intermediately thereon, respectively, which provide an initial sealing interference with seal bore 60 of casing hanger 32. Inner seal legs 72 and 76 have reduced diameter sealing surfaces 82 and 84 disposed intermediately thereon, respectively, which provide an initial sealing interference with seal surface 62 of seal nose 58.

A support ring 86 is positioned between seal legs 70 and 72 and an identical ring 86 is also positioned between seal legs 74 and 76. Rings 86 are annularly shaped with enlarged portion 88 positioned on one end thereof. When rings 86 are positioned between seal legs 70, 72 and 74, 76, the enlarged portions 88 contact the insides of the seal legs and maintain the initial interference of sealing surfaces 78, 80, 82 and 84. This support is at the tips of the seal legs to minimize the deflection of the seal legs and maintain the sealing contact of sealing surfaces 78, 80, 82 and 84 with seal bores 60 and 62.

Support rings 86 have axially directed holes 90 intersected by radially directed holes 92 disposed therein which serve to equalize any pressure within seal legs 70, 72 and 74, 76. Support rings 86 are slightly longer than seal legs 70, 72 and 74, 76, thereby providing a controlled length to the seal assembly 10. This controlled length permits retainer ring 94 to maintain seal assembly 10 in its proper position, without axial movement if required, against radial shoulder 64 and protects seal legs 70, 72 and 74, 76. Retainer ring 94 has internal thread 96 which engages the external thread 66 of seal nose 58 to secure seal assembly 10 in position. A snap ring 98 engages groove 100 in thread 66 to lock retainer ring 94 in position.

Figure 3:
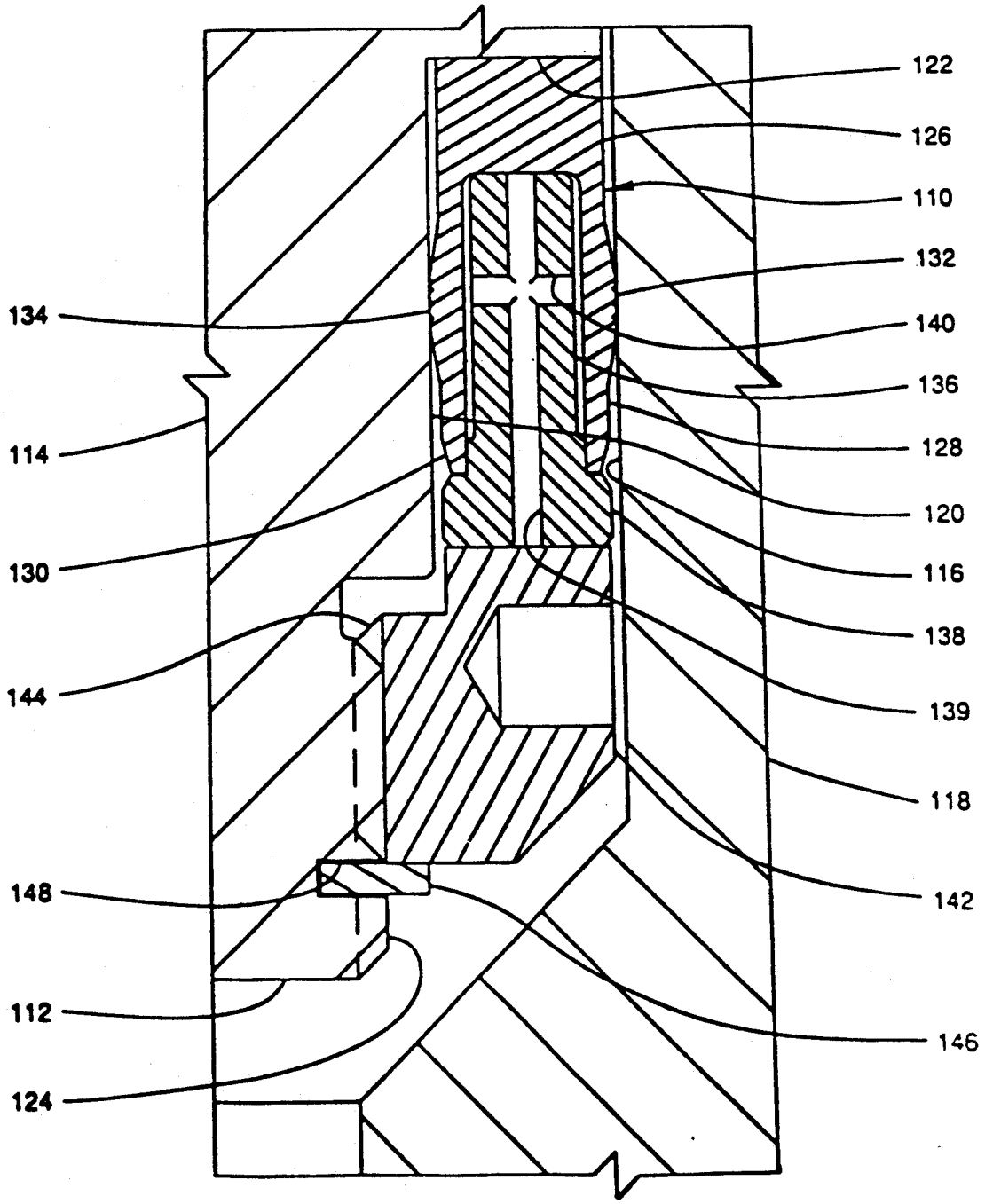
FIG. 3 is an enlarged partial sectional view of the seal in its unidirectional sealing configuration.

In some applications, such as a seal on a tubing hanger mandrel, it is desirable for the improved metal seal to hold pressure from only one direction. This alternate embodiment is shown in FIG. 3, on a greatly enlarged scale where the improved seal apparatus is denoted generally by numeral 110. The seal apparatus 110 is shown positioned on the exterior of seal nose 112 at the lowermost portion of seal stinger 114, sealing within seal bore 116 of tubing hanger 118. Reduced diameter portion 120 of seal nose 112 ends at radial shoulder 122 with seal 110 sealingly disposed thereon. An external thread 124 is positioned axially below seal surface 120 for purposes to be explained hereinafter.

The alternate seal apparatus 110 is essentially identical to the preferred embodiment seal apparatus 10 with the exception of having only one pair of seal legs. Seal apparatus 110 includes annular base portion 126 with outer seal leg 128 and inner seal leg 130 extending axially and downwardly therefrom. Outer seal leg 128 has enlarged diameter sealing surface 132 disposed intermediately thereon which provides an initial sealing interference with seal bore 116 of tubing hanger 118. Inner seal leg 130 has reduced diameter sealing surface 134 disposed intermediately thereon which provides an initial sealing interference with seal surface 120 of seal nose 112.

A support ring 136 is positioned between seal legs 128 and 130. Support ring 136 is annularly shaped with enlarged portion 138 positioned on one end thereof. When support ring 136 is positioned between seal legs 128 and 130 the enlarged portion 138 contacts the inside of seal legs 128 and 130 and maintains the initial interference of sealing surface 132 with seal bore 116 and the initial interference of sealing surface 134 with seal diameter 120. This support is at the tips of the seal legs to minimize the deflection of the seal legs and maintain the sealing contact of sealing surfaces 132 and 134 with seal bores 116 and 120, respectively.

As in the preferred embodiment, support ring 136 has axially directed holes 139 intersected by radially directed holes 140 disposed therein which serve to equalize any pressure within seal legs 128 and 130 at any time. Support ring 136 is slightly longer than seal legs 128 and 130 thereby providing a preset length to the seal assembly 110. This preset length permits retainer ring 142 to maintain seal assembly 110 in its proper position, without axial movement, against radial shoulder 122. Retainer ring 142 has internal thread 144 which engages the external thread 124 of seal nose 112 to secure seal assembly 110 in position. A snap ring 146 engages groove 148 in thread 124 to lock retainer ring 142 in position.

Figure 4:
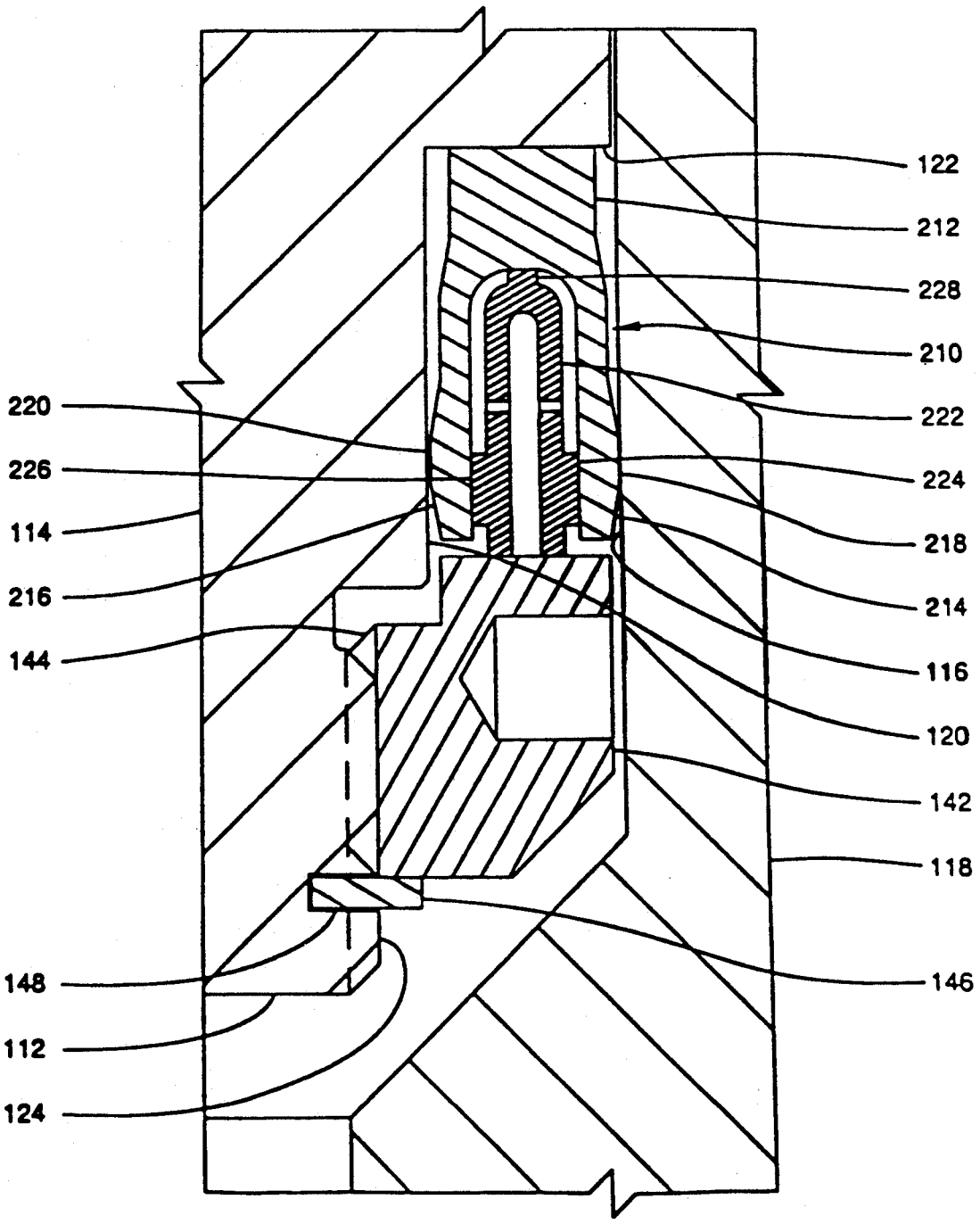
FIG. 4 is an enlarged partial sectional view of an alternate embodiment of the seal in a unidirectional sealing configuration with another form of support ring.

A second alternate embodiment showing another form of the improved metal-to-metal seal is shown in FIG. 4. Those items which are unchanged from the previous embodiment of FIG. 3 retain the same numeral designation. The improved metal seal 210 is disposed on reduced diameter portion 120 of seal nose 112, in sealing engagement with seal bore 116 of tubing hanger 118. Seal apparatus 210 includes annular base portion 212 which abuts radial shoulder 122. Outer seal leg 214 and inner seal leg 216 extend axially from annular base 212. Outer seal leg 214 has enlarged diameter sealing surface 218 disposed intermediately thereon which provides an initial sealing interference with seal bore 116 of tubing hanger 118. Inner seal leg 216 has reduced diameter sealing surface 220 disposed intermediately thereon which provides an initial sealing interference with seal surface 120 of seal nose 112.

A support ring 222 is positioned between seal legs 214 and 216. Support ring 222 is an annular ring with a generally U shaped cross section. Support ring 222 has an enlarged outer diameter portion 224 and a reduced diameter inner portion 226 disposed near the tips of the legs of ring 222. When support ring 222 is positioned between seal legs 214 and 216, an enlarged base portion 228 contacts the inside of seal legs 214 and 216 at their juncture with base portion 212. This contact positions the enlarged annular portion 224 and reduced annular portion 226 of support ring 222 opposite the seal surfaces 218 and 220, respectively, of seal apparatus 210. As in the preferred embodiment, support ring 222 has radially directed holes disposed therein which serve to equalize any pressure within seal legs 214 and 216. The support ring 222 is made of a much harder and stiffer material than seal apparatus 210 thereby giving the legs of support ring 222 a greater stiffness than seal legs 214 and 216. This greater stiffness maintains the initial interference of sealing surface 218 with seal bore 116 and the initial interference of sealing surface 220 with seal diameter 120.

As in the preferred embodiment, support ring 222 is slightly longer than seal legs 214 and 216 to provide a preset length to the seal assembly 210. This preset length permits retainer ring 142 to maintain seal assembly 210 in its proper position, without axial movement, against radial shoulder 122. Retainer ring 142 has internal thread 144 which engages the external thread 124 of seal nose 112 to secure seal assembly 210 in position. A snap ring 146 engages groove 148 in thread 124 to lock retainer ring 142 in position.

What is claimed is:

1. An annular seal assembly for sealing the annulus between a seal bore and a seal member disposed therein, comprising:

an annular base, an inner and an outer seal leg extending from said base to define a seal annulus therebetween and having an initial sealing interference with said seal member and said seal bore, said inner and said outer seal legs each terminating in a tip, said annular seal assembly including:

an enlarged diameter seal surface on said outer seal leg, a reduced diameter seal surface on said inner seal leg, said reduced diameter seal surface having an initial sealing interference with said seal member, said enlarged diameter seal surface having an initial sealing interference with said seal bore upon insertion of said seal member into said seal annulus, and means for retaining said seal assembly on said seal member, and an annular support ring disposed between said inner and said outer seal legs supporting said inner and outer seal legs in sealing engagement with said seal bore and maintaining said reduced diameter seal surface in sealing engagement with said seal member wherein:

said annular support ring has a substantially rectangular configuration with an enlarged end portion, said enlarged end portion is radially disposed and supports said inner and outer seal legs at their tips, said annular support ring includes a plurality of radially disposed circumferentially spaced holes, and each of said radially disposed circumferentially spaced holes intersected by an axially disposed hole wherein said axial and radial holes prevent fluid block during assembly and installation and balance pressure distribution within said annular seal.

2. An annular seal assembly according to claim 1 wherein:

said annular support ring has a reduced cross section which extends axially inwardly from said tip to the annular base of said inner and outer seal legs and prevents axial movement of said support ring with respect to said seal legs.

3. An annular seal assembly for sealing the annulus between a seal bore and a seal member disposed therein, comprising:

an annular base, an inner and an outer seal leg extending from said base to define a seal annulus therebetween and having an initial sealing interference with said seal member and said seal bore, said inner and said outer seal legs each terminating in a tip, said annular seal assembly including:

an enlarged diameter seal surface on said outer seal leg, a reduced diameter seal surface on said inner seal leg, said reduced diameter seal surface having an initial sealing interference with said seal member, said enlarged diameter seal surface having an initial sealing interference with said seal bore upon insertion of said seal member into said seal annulus, and means for retaining said seal assembly on said seal member, and an annular support ring disposed between said inner and said outer seal legs supporting said inner and outer seal legs in sealing engagement with said seal bore and maintaining said reduced diameter seal surface in sealing engagement with said seal member wherein:

said annular support ring has a substantially rectangular configuration with an enlarged end portion, said enlarged end portion is radially disposed and supports said inner and outer seal legs on their interior adjacent enlarged diameter seal surface and adjacent said reduced diameter seal surface, said annular support ring includes a plurality of radially disposed circumferentially spaced holes, each of said radially disposed circumferentially spaced holes intersected by an axially disposed hole wherein said axial and radial holes prevent fluid block during assembly and installation and balance pressure distribution within said annular seal.

4. An annular seal assembly according to claim 3 wherein:

said annular support ring has a reduced cross section which extends axially inwardly from said tip to the annular base of said inner and outer seal legs and prevents axial movement of said support ring with respect to said seal legs.

5. An annular seal assembly for sealing the annulus between a seal bore and a seal member disposed therein, comprising:

an annular base, an upper inner and an upper outer seal leg extending from said base having an initial sealing interference with said seal member and said seal bore, a lower inner and a lower outer seal leg extending from said base having an initial sealing interference with said seal member and said seal bore, said upper inner and said upper outer seal legs each terminating in a tip, said lower inner and said lower outer seal legs each terminating in a tip, said annular seal assembly including:

an enlarged diameter seal surface on said upper and lower outer seal legs, a reduced diameter seal surface on said upper and lower inner seal legs, said reduced diameter seal surfaces having an initial sealing interference with said seal member, said enlarged diameter seal surfaces having an initial sealing interference with said seal bore upon insertion of said seal member into said seal annulus, and means for retaining said seal assembly on said seal member, and an annular support ring disposed between said upper inner and outer seal legs supporting said upper inner and outer seal legs, an annular support ring disposed between said lower inner and outer seal legs supporting said lower inner and outer seal legs, and said support rings maintaining said enlarged diameter seal surfaces in sealing engagement with said seal bore and maintaining said reduced diameter seal surfaces in sealing engagement with said seal member wherein:

said annular support rings have a substantially rectangular configuration with an enlarged end portion, said enlarged end portions are radially disposed and support said inner and outer seal legs at their tips, said annular support rings include a plurality of radially disposed circumferentially spaced holes, and each of said radially disposed circumferentially spaced holes intersected by an axially disposed hole wherein said axial and radial holes prevent fluid block during assembly and installation and balance pressure distribution within said annular seal.

6. An annular seal assembly according to claim 5 wherein:

said annular support rings have a reduced cross section which extends axially inwardly from said tip to the annular base of said inner and outer seal legs and prevents axial movement of said support ring with respect to said seal legs.

7. An annular seal assembly for sealing the annulus between a seal bore and a seal member disposed therein, comprising:

an annular base, an inner and an outer seal leg extending from said base to define a seal annulus therebetween and having an initial sealing interference with said seal member and said seal bore, said inner and said outer seal legs each terminating in a tip, said annular seal assembly including:

an enlarged diameter seal surface on said outer seal leg, a reduced diameter seal surface on said inner seal leg, said reduced diameter seal surface having an initial sealing interference with said seal member, said enlarged diameter seal surface having an initial sealing interference with said seal bore upon insertion of said seal member into said seal annulus, and means for retaining said seal assembly on said seal member, and an annular support ring disposed between said inner and said outer seal legs supporting said inner and outer seal legs in sealing engagement with said seal bore and maintaining said reduced diameter seal surface in sealing engagement with said seal member wherein:

said annular support ring has a substantially U shaped configuration having interior and exterior annular projections adjacent said enlarged diameter and reduced diameter seal surfaces, said annular support ring includes a plurality of radially disposed circumferentially spaced holes, said radially disposed circumferentially spaced holes preventing fluid block during assembly and installation and balance pressure distribution within said annular seal.

8. An annular seal assembly according to claim 7 wherein:

said annular support ring has a reduced cross section which extends axially inwardly from said tip to the annular base of said inner and outer seal legs and prevents axial movement of said support ring with respect to said seal legs.

* * * * *